US007984575B2

(12) United States Patent
Robl et al.

(10) Patent No.: US 7,984,575 B2
(45) Date of Patent: Jul. 26, 2011

(54) QUICK COUPLER ASSEMBLY

(75) Inventors: Troy Curtis Robl, Manhattan, KS (US); Trent Randall Stefek, Manhattan, KS (US)

(73) Assignee: Caterpillar Inc., Peoria, IL (US)

( * ) Notice: Subject to any disclaimer, the term of this patent is extended or adjusted under 35 U.S.C. 154(b) by 278 days.

(21) Appl. No.: 11/773,655

(22) Filed: Jul. 5, 2007

(65) Prior Publication Data

US 2009/0007465 A1 Jan. 8, 2009

(51) Int. Cl.
*E02F 3/96* (2006.01)

(52) U.S. Cl. ..... 37/468; 37/403; 172/273; 414/723; 403/322.1

(58) Field of Classification Search ..... 37/468, 37/403; 172/272, 274, 275; 403/321, 322.1, 403/324, 315, 316; 414/723
See application file for complete search history.

(56) References Cited

U.S. PATENT DOCUMENTS

| | | | | |
|---|---|---|---|---|
| 3,556,323 | A | 1/1971 | Heimmermann | |
| 3,961,812 | A * | 6/1976 | Von Allworden | 172/275 |
| 4,187,050 | A * | 2/1980 | Barbee | 414/723 |
| 4,214,840 | A | 7/1980 | Beales | |
| 4,295,287 | A | 10/1981 | Natzke et al. | |
| 4,366,967 | A * | 1/1983 | Vollmer et al. | 280/504 |
| 4,373,852 | A | 2/1983 | Maurer | |
| 4,397,604 | A * | 8/1983 | McCain | 414/723 |
| 4,417,844 | A | 11/1983 | de Pingon | |
| 4,480,955 | A | 11/1984 | Andrews et al. | |
| 4,632,595 | A | 12/1986 | Schaeff | |
| 4,643,631 | A | 2/1987 | Maurer et al. | |
| 4,779,364 | A | 10/1988 | Holmdal | |
| 4,790,084 | A | 12/1988 | Anderson et al. | |
| 4,810,162 | A * | 3/1989 | Foster | 414/723 |
| 4,845,867 | A | 7/1989 | Albrecht | |
| 4,854,813 | A | 8/1989 | Degeeter et al. | |
| 4,871,292 | A * | 10/1989 | Milanowski | 414/723 |
| 4,881,867 | A | 11/1989 | Essex et al. | |
| 4,906,161 | A | 3/1990 | Weyer | |
| 4,955,779 | A | 9/1990 | Knackstedt | |
| 4,958,981 | A | 9/1990 | Uchihashi | |
| 5,010,962 | A | 4/1991 | Bloom | |
| 5,024,010 | A | 6/1991 | Hulden | |
| 5,082,389 | A | 1/1992 | Balemi | |
| 5,107,610 | A | 4/1992 | Fusco | |
| 5,108,252 | A | 4/1992 | Gilmore et al. | |
| 5,110,254 | A | 5/1992 | Aubrey | |
| 5,125,788 | A | 6/1992 | Stenger | |
| 5,141,385 | A | 8/1992 | Tibbatts et al. | |
| 5,145,313 | A | 9/1992 | Weyer | |
| 5,147,173 | A | 9/1992 | Fauber et al. | |
| 5,179,794 | A | 1/1993 | Ballinger | |

(Continued)

FOREIGN PATENT DOCUMENTS

| | | |
|---|---|---|
| EP | 0306340 | 3/1989 |

(Continued)

*Primary Examiner* — Thomas A Beach
(74) *Attorney, Agent, or Firm* — Leydig, Voit & Mayer

(57) ABSTRACT

A quick coupler for connecting and disconnecting an implement such as a bucket to and from a machine such as an excavator. In an example, the quick coupler includes a frame having recesses configured to receive pins located on the implement. The quick coupler includes first and second securing latches that are movable between latched and unlatched positions for removably latching the pins of the implement in the recesses. A rocker assembly and a connector link are provided for moving the second latch between latched and unlatched positions.

24 Claims, 4 Drawing Sheets

U.S. PATENT DOCUMENTS

| | | | | |
|---|---|---|---|---|
| 5,195,865 | A | 3/1993 | Koehl | |
| 5,237,762 | A | 8/1993 | Sandberg | |
| 5,242,258 | A | 9/1993 | Weyer | |
| 5,256,026 | A | 10/1993 | Kishi | |
| 5,324,162 | A | 6/1994 | Kishi | |
| 5,332,353 | A * | 7/1994 | Arnold | 414/723 |
| 5,333,400 | A | 8/1994 | Sonerud | |
| 5,333,695 | A | 8/1994 | Walter | |
| 5,350,250 | A | 9/1994 | Nagler | |
| 5,360,313 | A | 11/1994 | Gilmore et al. | |
| 5,382,110 | A | 1/1995 | Perotto | |
| 5,394,630 | A | 3/1995 | Moinat | |
| 5,400,531 | A * | 3/1995 | Brown | 37/468 |
| 5,415,235 | A | 5/1995 | Gebauer | |
| 5,423,625 | A | 6/1995 | Gebauer | |
| 5,431,528 | A | 7/1995 | Jenkins et al. | |
| 5,441,117 | A * | 8/1995 | Fartmann et al. | 172/272 |
| 5,456,030 | A | 10/1995 | Barone et al. | |
| 5,465,513 | A | 11/1995 | Sonerud | |
| 5,467,542 | A | 11/1995 | Hulden | |
| 5,487,230 | A | 1/1996 | Weyer | |
| 5,494,396 | A | 2/1996 | Geier et al. | |
| 5,515,626 | A | 5/1996 | Holscher | |
| 5,546,683 | A | 8/1996 | Clark | |
| 5,549,440 | A | 8/1996 | Cholakon et al. | |
| 5,575,093 | A | 11/1996 | Pratt et al. | |
| 5,581,917 | A | 12/1996 | Barden | |
| 5,584,644 | A | 12/1996 | Droegemueller | |
| 5,597,283 | A | 1/1997 | Jones | |
| 5,611,158 | A | 3/1997 | Pratt et al. | |
| 5,618,157 | A | 4/1997 | Pratt et al. | |
| 5,621,987 | A | 4/1997 | Pratt | |
| 5,634,735 | A | 6/1997 | Horton et al. | |
| 5,634,736 | A | 6/1997 | Brown et al. | |
| 5,642,785 | A | 7/1997 | Dam-Rasmussen | |
| 5,685,689 | A | 11/1997 | Schneider et al. | |
| 5,692,325 | A | 12/1997 | Kuzutani | |
| 5,692,850 | A | 12/1997 | Kimble et al. | |
| 5,692,852 | A | 12/1997 | Collins | |
| 5,727,342 | A | 3/1998 | Horton | |
| 5,779,429 | A | 7/1998 | Poole | |
| 5,791,863 | A | 8/1998 | Droegemueller | |
| 5,802,753 | A | 9/1998 | Raunisto | |
| 5,813,822 | A | 9/1998 | Pisco | |
| 5,820,332 | A | 10/1998 | Philips et al. | |
| 5,865,594 | A | 2/1999 | Kim | |
| 5,890,871 | A | 4/1999 | Woerman | |
| 5,915,837 | A | 6/1999 | Brown et al. | |
| 5,951,192 | A | 9/1999 | Collins | |
| 5,966,850 | A | 10/1999 | Horton | |
| 5,974,706 | A | 11/1999 | Kaczmarski et al. | |
| 5,983,535 | A | 11/1999 | Kaczmarski et al. | |
| 6,000,154 | A | 12/1999 | Berard et al. | |
| 6,042,295 | A | 3/2000 | Barden | |
| 6,058,633 | A | 5/2000 | Barden | |
| 6,074,120 | A | 6/2000 | Williams | |
| 6,088,938 | A | 7/2000 | Logan | |
| 6,088,939 | A | 7/2000 | Logan | |
| 6,108,951 | A | 8/2000 | Renfrow et al. | |
| 6,123,501 | A | 9/2000 | Pisco | |
| 6,132,130 | A | 10/2000 | McCann | |
| 6,132,131 | A | 10/2000 | Nakamura et al. | |
| 6,139,212 | A | 10/2000 | Heiple | |
| 6,154,989 | A | 12/2000 | Kaczmarski et al. | |
| 6,158,950 | A | 12/2000 | Wilt et al. | |
| 6,163,988 | A | 12/2000 | Pratt et al. | |
| 6,163,989 | A | 12/2000 | Kaczmarski et al. | |
| 6,168,369 | B1 | 1/2001 | Bright et al. | |
| 6,196,595 | B1 | 3/2001 | Sonerud | |
| 6,202,331 | B1 | 3/2001 | Kobayashi | |
| D440,983 | S | 4/2001 | Miller et al. | |
| 6,227,792 | B1 | 5/2001 | Baker et al. | |
| 6,231,296 | B1 | 5/2001 | Blomgren | |
| 6,233,852 | B1 | 5/2001 | Pemberton | |
| 6,241,455 | B1 | 6/2001 | Schupback et al. | |
| 6,254,331 | B1 | 7/2001 | Pisco et al. | |
| 6,260,357 | B1 | 7/2001 | Goodfellow et al. | |
| RE37,320 | E | 8/2001 | Horton | |
| RE37,339 | E | 8/2001 | Horton | |
| 6,301,811 | B1 | 10/2001 | Gilmore, Jr. | |
| 6,302,611 | B1 | 10/2001 | de Gier et al. | |
| 6,305,106 | B1 | 10/2001 | Mclellan | |
| 6,308,442 | B1 | 10/2001 | Naka et al. | |
| 6,312,212 | B1 | 11/2001 | Burlew, Jr. | |
| 6,332,732 | B1 | 12/2001 | Mantovani | |
| 6,332,747 | B1 | 12/2001 | Lee | |
| 6,336,785 | B1 | 1/2002 | Kunzman | |
| 6,350,079 | B1 | 2/2002 | Williams | |
| D455,762 | S | 4/2002 | Kaczmarski et al. | |
| 6,364,561 | B1 | 4/2002 | Droegemueller | |
| 6,379,075 | B1 | 4/2002 | Shamblin et al. | |
| 6,385,872 | B1 | 5/2002 | Mieger et al. | |
| 6,386,822 | B1 | 5/2002 | Burr | |
| 6,408,875 | B1 | 6/2002 | Nishikawa et al. | |
| 6,422,805 | B1 | 7/2002 | Miller | |
| 6,428,265 | B1 | 8/2002 | Gilmore, Jr. | |
| 6,431,785 | B1 | 8/2002 | Melander | |
| 6,438,875 | B1 | 8/2002 | Kimble et al. | |
| 6,481,124 | B1 | 11/2002 | Miller | |
| 6,487,800 | B1 | 12/2002 | Evans et al. | |
| 6,493,967 | B2 | 12/2002 | Holmes et al. | |
| 6,499,904 | B2 | 12/2002 | Nye | |
| 6,508,616 | B2 * | 1/2003 | Hung | 414/723 |
| 6,513,268 | B2 | 2/2003 | Lee et al. | |
| 6,533,528 | B2 | 3/2003 | Degen et al. | |
| 6,533,529 | B2 | 3/2003 | Waggoner | |
| 6,539,650 | B2 | 4/2003 | Kaczmarski et al. | |
| 6,606,805 | B2 | 8/2003 | Kimble et al. | |
| 6,615,514 | B2 | 9/2003 | Ruiz | |
| 6,625,909 | B1 | 9/2003 | Miller et al. | |
| 6,629,811 | B1 | 10/2003 | Husson | |
| 6,644,885 | B2 | 11/2003 | Dam-Rasmussen | |
| 6,655,053 | B1 | 12/2003 | Cummungs | |
| 6,658,770 | B2 | 12/2003 | Heiple | |
| 6,659,708 | B2 | 12/2003 | Heiple | |
| 6,659,709 | B1 | 12/2003 | Anderson | |
| 6,688,801 | B2 | 2/2004 | Husson | |
| 6,691,438 | B2 | 2/2004 | Fatemi | |
| 6,699,001 | B2 | 3/2004 | Fatemi | |
| 6,709,224 | B2 | 3/2004 | Heiple | |
| 6,718,663 | B1 | 4/2004 | Geraghty | |
| 6,725,584 | B2 | 4/2004 | Inoue et al. | |
| 6,811,371 | B2 | 11/2004 | Mantovani | |
| 6,813,851 | B2 | 11/2004 | Mieger | |
| 6,857,842 | B2 | 2/2005 | Heiple | |
| 6,877,259 | B2 | 4/2005 | Nishimura et al. | |
| 6,881,002 | B2 | 4/2005 | Fatemi | |
| 6,886,279 | B2 | 5/2005 | Kimble | |
| 6,899,509 | B1 | 5/2005 | Mailleux | |
| 6,902,346 | B2 | 6/2005 | Steig, Jr. et al. | |
| 6,922,926 | B2 | 8/2005 | Miller et al. | |
| 6,964,122 | B2 * | 11/2005 | Cunningham et al. | 37/468 |
| 7,426,796 | B2 * | 9/2008 | Cunningham et al. | 37/468 |
| 2001/0026729 | A1 | 10/2001 | Trowbridge | |
| 2001/0053323 | A1 | 12/2001 | Godwin et al. | |
| 2002/0066215 | A1 | 6/2002 | Kaczmarski et al. | |
| 2002/0071754 | A1 | 6/2002 | Fatemi | |
| 2002/0098032 | A1 | 7/2002 | Nye | |
| 2002/0136597 | A1 | 9/2002 | Nishikawa et al. | |
| 2002/0157286 | A1 | 10/2002 | Fatemi | |
| 2002/0157287 | A1 | 10/2002 | Mieger et al. | |
| 2002/0170211 | A1 | 11/2002 | Lee et al. | |
| 2002/0174575 | A1 | 11/2002 | Inoue et al. | |
| 2002/0176772 | A1 | 11/2002 | Hung | |
| 2002/0178625 | A1 | 12/2002 | Kimble et al. | |
| 2003/0005605 | A1 | 1/2003 | Kaczmarski et al. | |
| 2003/0095858 | A1 | 5/2003 | Mantovani | |
| 2003/0099507 | A1 | 5/2003 | Fatemi | |
| 2003/0103806 | A1 | 6/2003 | Short | |
| 2003/0131505 | A1 | 7/2003 | Heiple | |
| 2003/0133779 | A1 | 7/2003 | Heiple | |
| 2003/0154636 | A1 | 8/2003 | Miller et al. | |
| 2003/0175072 | A1 | 9/2003 | Steig et al. | |
| 2003/0204972 | A1 | 11/2003 | Cunningham et al. | |
| 2003/0233773 | A1 | 12/2003 | Mieger et al. | |
| 2004/0000077 | A1 | 1/2004 | Fatemi | |

| | | | |
|---|---|---|---|
| 2004/0028515 | A1 | 2/2004 | Martin |
| 2004/0057784 | A1 | 3/2004 | Geraghty et al. |
| 2004/0076504 | A1 | 4/2004 | Geraghty |
| 2004/0165979 | A1 | 8/2004 | Fatemi |
| 2004/0184875 | A1 | 9/2004 | Mieger et al. |
| 2004/0218971 | A1 | 11/2004 | Lim et al. |
| 2004/0247382 | A1 | 12/2004 | Leemans et al. |
| 2005/0169703 | A1 | 8/2005 | Fatmi |
| 2005/0204591 | A1 | 9/2005 | Mieger et al. |
| 2005/0214105 | A1 | 9/2005 | Steig et al. |
| 2007/0039213 | A1 | 2/2007 | Miller |
| 2007/0157492 | A1 | 7/2007 | Miller et al. |

FOREIGN PATENT DOCUMENTS

| | | |
|---|---|---|
| EP | 1318242 | 11/2003 |
| GB | 2332417 | 6/1999 |
| GB | 2372979 | 1/2001 |
| WO | 2005026454 | 3/2005 |

* cited by examiner

QUICK COUPLER ASSEMBLY

TECHNICAL FIELD

This patent disclosure relates generally to a coupler and, more particularly to a quick coupler for connecting and disconnecting an implement such as a bucket to and from a machine such as an excavator.

BACKGROUND

Quick couplers are generally well known and can be found in many systems and devices. Typically, a quick coupler is fixed to an arm of a machine for connecting and disconnecting the arm to and from implements. For example, a quick coupler can be attached to the arm of an excavator for connecting and disconnecting the aim to and from implements such as buckets, hammers, rippers, and grapples. Such quick couplers are advantageous because they allow a machine operator to change quickly from one implement to another. Thus, the use of a quick coupler makes the machine more efficient and versatile.

Several different types of quick couplers have been employed in the past. One exemplary quick coupler is disclosed in U.S. Pat. No. 6,902,346 for a Hydraulic Coupler, filed on Mar. 15, 2002 and issued to Kenneth M. Steig, Jr., et al. on Jun. 7, 2005. Quick couplers, such as disclosed in Steig, typically include a body, recesses in the body for receiving machine pins of an implement, first and second locking latches for opening and closing the recesses, and a piston and cylinder device connected to the first and second locking latches for moving the latches between open and closed positions. In this type of quick coupler, the machine pins of the implement can be seated in the recesses and can be retained therein by the locking latches. However, a shortcoming to these quick couplers is that hydraulic failure can cause the piston to retract into the cylinder, thereby moving the locking latches from the closed position to the open position. This could cause the machine pins to unseat from the recesses and the implement to unexpectedly disconnect from the quick coupler. To prevent such disconnections, these known quick couplers can include a compression spring positioned around the piston to prevent the piston from retracting into the cylinder when hydraulic failure occurs. These quick couplers also provide manually installed locking pins for securing the first and second locking latches to the body of the coupler, thereby preventing the locking latches from moving to the open position upon hydraulic failure. The compression spring, however, is undesirable because it is susceptible to being overcome by forces acting on the piston, and the locking pins are undesirable because manual labor is required to install them.

BRIEF SUMMARY

The present disclosure describes a quick coupler assembly for connecting and disconnecting an implement to and from an arm of a machine. The quick coupler includes a frame having recesses or notches for receiving a pair of machine pins located on the implement, securing latches for securing the pins in the recesses or notches, an actuator for latching and unlatching the securing latches, and an over-center latching system for ensuring that the latches remain latched even if the actuator fails. The quick coupler of the present disclosure, including the over-center latching system, eliminates the need for including a compression spring about the piston that acts as a safety back-up for securing latches in the latched position should the actuator fail. Further, the present device eliminates the need to manually install locking pins through aligned openings in the frame to prevent the latches from unlatching.

In one aspect, the quick coupler assembly has a frame having front and rear portions, a notch, and a recess in the form of an open jaw. The notch is located proximate to the front portion of the frame and the recess is located proximate to the rear portion. The notch is configured to receive a first pin of an implement, and the recess is configured to receive a second pin of the implement. The coupler also includes a first securing latch pivotally connected proximate to the front portion of the frame and movable between latched and unlatched positions for latching the first pin of the implement in the notch, and a second securing latch pivotally connected proximate to the rear portion of the frame and movable between latched and unlatched positions for latching the second pin of the implement in the recess. A rocker assembly, having a stopping surface, is pivotally mounted to the frame by a rocker pivot pin.

In addition, a connector link is pivotally connected to the rocker assembly by a first pivot pin, and the connector link is pivotally connected to the second securing latch by a second pivot pin. The frame also includes a boss member, having a stopping surface, placed proximate to the rear portion of the frame.

DETAILED DESCRIPTION

This disclosure relates to a system and method for an improved quick coupler. In the described system, an actuator is used to move securing latches between latched and unlatched positions for removably coupling an implement, such as a bucket or grapple, to the arm of a machine, such as an excavator or backhoe. Actuators, however, can be prone to failure, e.g. hydraulic failure may occur in hydraulic actuators, and such failure may cause the implement to decouple unexpectedly from the arm. The described quick coupler provides an over-center locking system to ensure that at least one of the latches remains locked in the latched position should actuator failure occur. Additional and alternative aspects will become apparent from consideration of the following.

Figure 1:
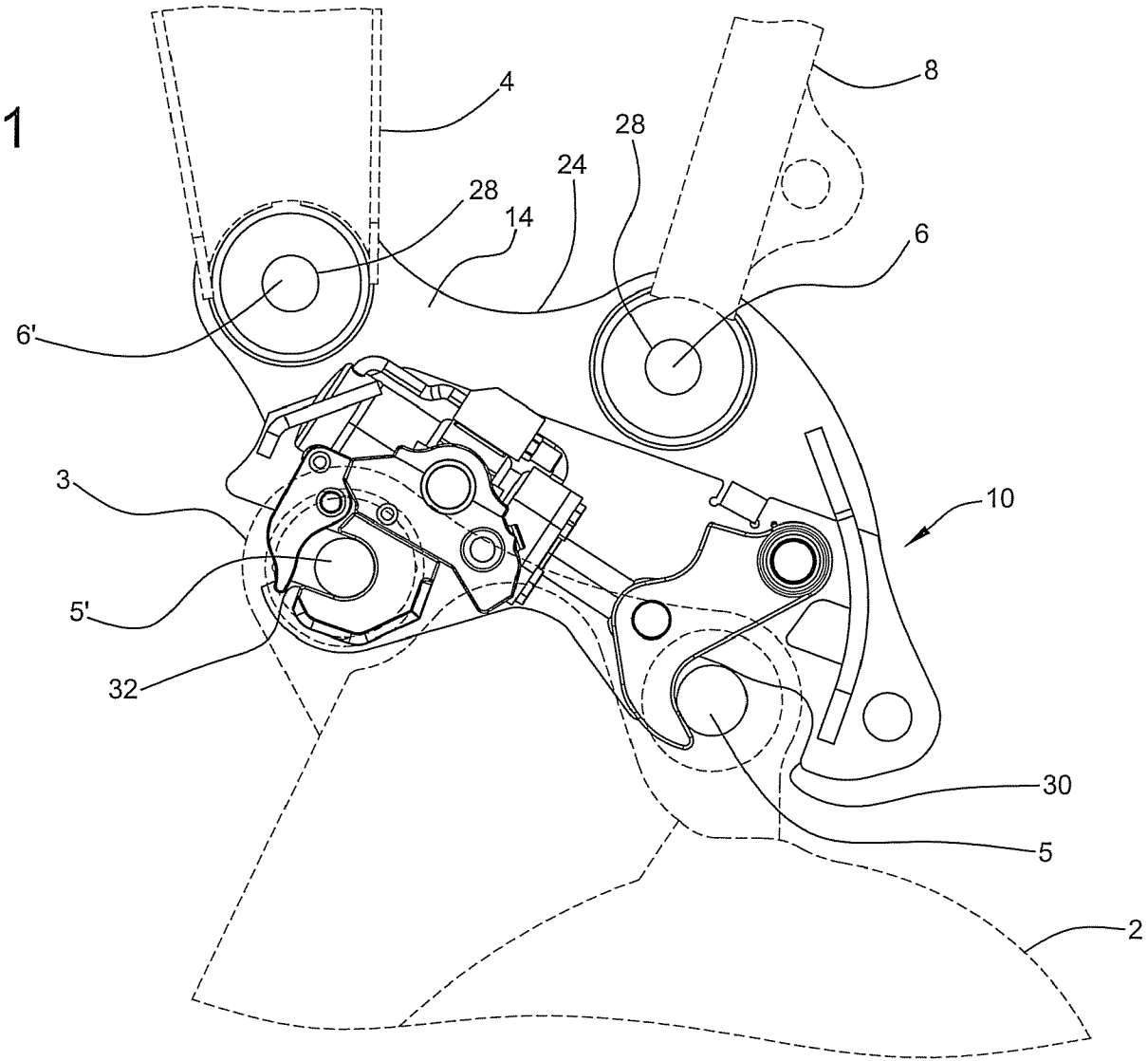
FIG. 1 is fragmentary, side view of a quick coupler for detachably coupling an implement to an arm of a machine, the quick coupler as shown is coupling a bucket-type implement to a the arm of a typical excavator.
Figure 2:
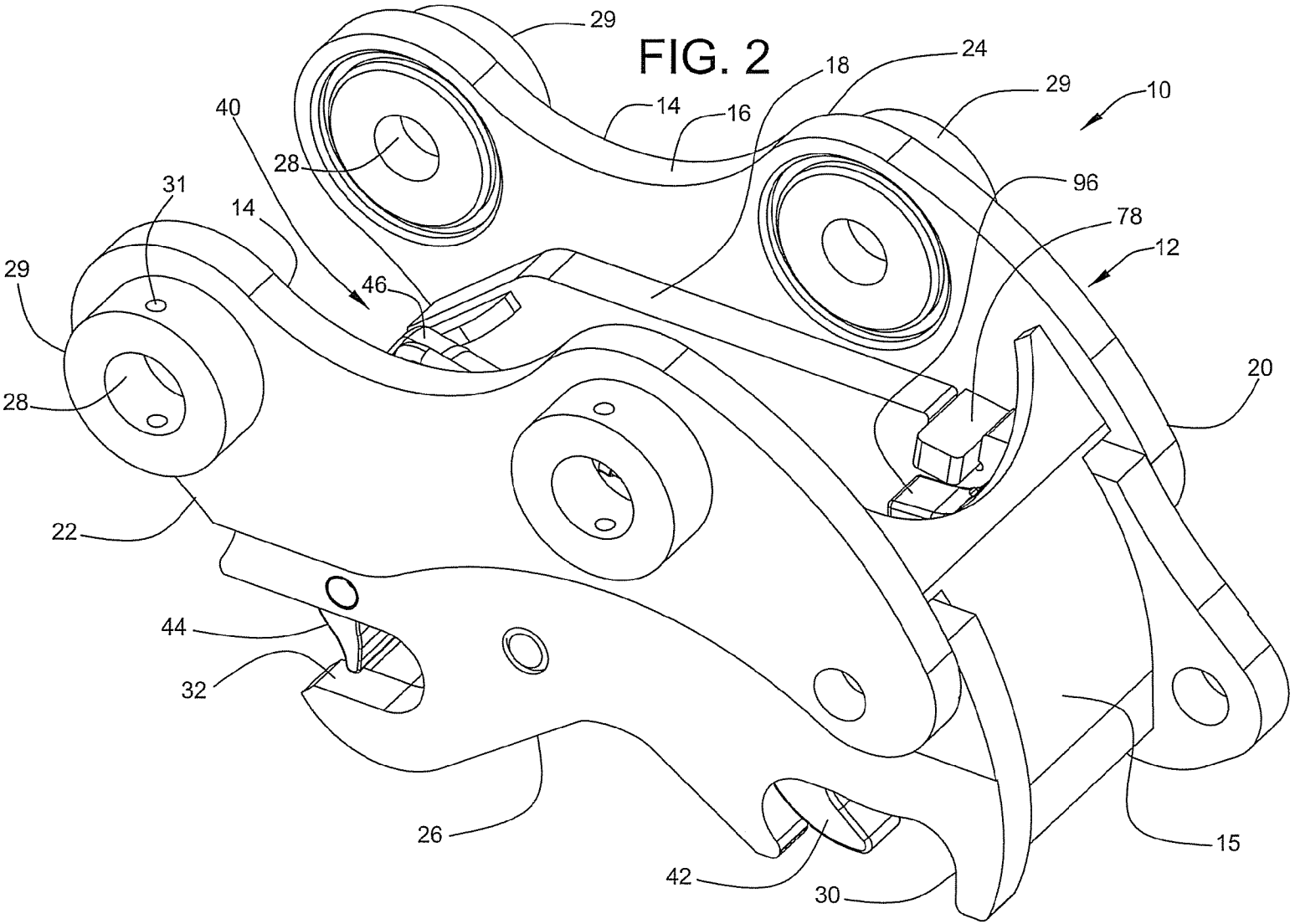
FIG. 2 is a front, perspective view of the quick coupler of FIG. 1.

Referring to FIGS. 1 and 2, a quick coupler 10 is provided for detachably connecting an implement 2, such as a bucket, to the distal end of a support arm or stick 4 of a machine (not shown), such as an excavator or backhoe. It should be appreciated that instead of a bucket, the implement may be a grapple, a hammer, a multi-processor, a rake, a ripper, a saw, or mechanical shears, etc. The implement 2 is provided with a pair of upstanding brackets 3, one of which is shown in FIG. 1. The brackets 3 are spaced apart by a predetermined distance, and a pair of machine pins 5, 5' extends between the brackets 3.

The quick coupler 10 includes a frame 12 having a pair of spaced apart, parallel side plates 14 that are interconnected by a cross plate 15. Each plate 14 comprises upper and lower plates 16, 18. However, it will be appreciated that one-piece plates may be used instead of the exemplary upper and lower plates 16, 18. The frame 12 further includes front and rear portions 20, 22 and top and bottom portions 24, 26.

The top portion 24 of the frame 12 is configured to connect to the stick 4 of the excavator (not shown). In the exemplary embodiment, the plates 14 include two sets of aligned pin openings 28 formed in the top portion 24 of the frame 12. Collars 29 having securing slots 31 are provided adjacent to each pin opening 28. It will be appreciated that the quick coupler 10 can be pivotally connected to the support arm 4 of the excavator (not shown) by pin 6' which is mounted within one of the pin openings 28 of the plates 14. Likewise, the coupler 10 can be pivotally connected to a power link 8 by pin 6. Securing pins (not shown) can be inserted through the securing slots 31 of the collars 29 and corresponding slots (not shown) formed in the pins 6, 6' for securing the pins 6, 6' in the openings 28. Thus, link 8 is operatively connected to the arm 4 for pivoting the coupler 10 about the pin 6'.

The bottom portion 26 of the quick coupler 10 is configured to detachably connect to the implement 2. In the exemplary embodiment, each plate 14 includes a recess or notch 30 and a recess 32 shown in the form of an open jaw. The notches 30 are disposed proximate to the front 20 and bottom 26 portions of the frame 12, while the recesses 32 are disposed proximate to the rear 22 and bottom 26 portions of the frame 12. The notches 30 are configured to receive the first machine pin 5 of the implement 2 and the recesses 32 are configured to receive the second machine pin 5'.

Figure 3:
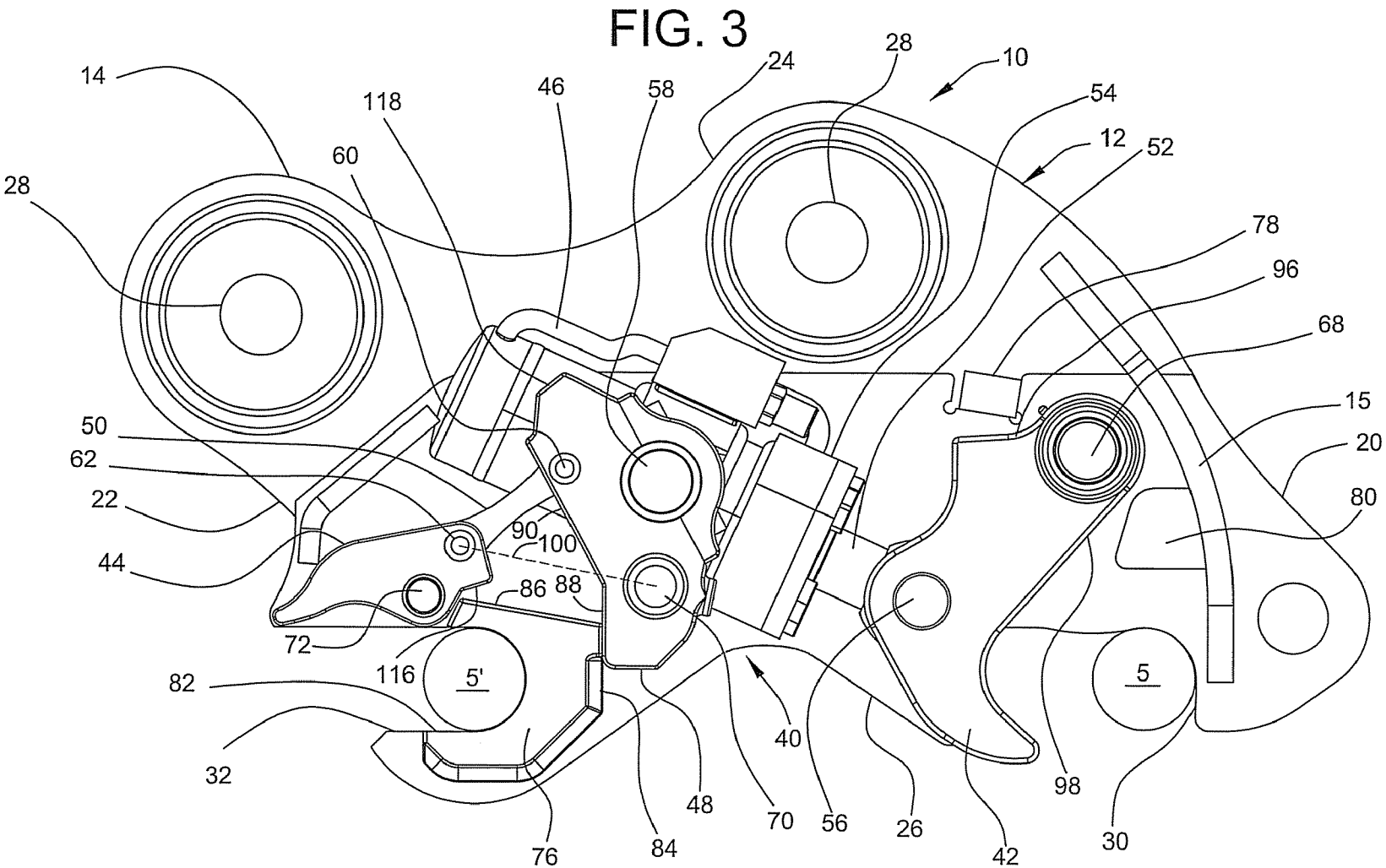
FIG. 3 is a side view with parts broken away, showing the quick coupler of FIG. 1 in an unlatched position.
Figure 4:
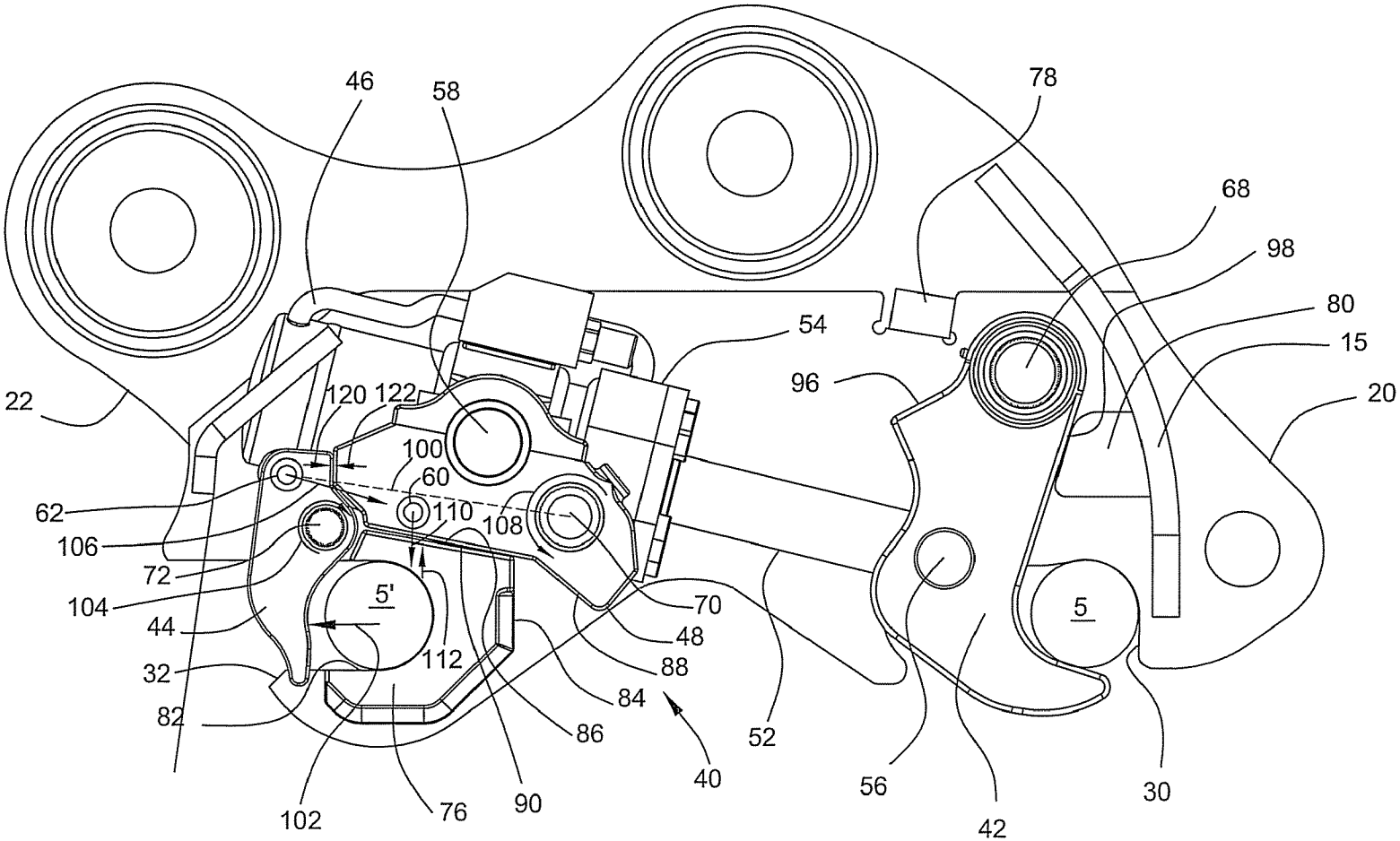
FIG. 4 is a side view with parts broken away, showing the quick coupler of FIG. 1 in a latched position.

FIGS. 3 and 4 are side views of the quick coupler 10 having a side plate 14 broken away for illustrating an over-center locking system 40 that includes first and second securing latches 42, 44 for securing pins 5, 5' in the notches 30 and recesses 32, respectively. FIG. 3 illustrates the locking system 40 in an unlocked position, while FIG. 4 illustrates the locking system 40 in a locked position. It should be appreciated that a gap exists between the second securing latch 44 and the pin 5' when the system 40 is latched or in the locked position.

The locking system 40 includes a number of interconnected components for moving the first and second securing latches 42, 44 between locked and unlocked positions. For example, the locking system 40 includes an actuator 46, a pair of rocker assemblies 48, and a pair of connector links 50.

Interconnections and mechanical relationships among the various components of an exemplary over-center locking system 40 will now be described. The first securing latch 42 and the actuator 46 are interconnected by a pivot pin 56. More particularly, the pivot pin 56 passes through corresponding bores formed in the first latch 42 and the piston 52. The rocker assemblies 48 are pivotally mounted, to opposing sides of the cylinder 54, on pivots 58 that extend from the respective sides of the cylinder 54 and pass through corresponding bores formed in the rocker assemblies 48. The connector links 50 pivotally connect the rocker assemblies 48 to the second latch 44, and first and second pivot pins 60, 62, respectively, connect the connector links 50 to both the rocker assemblies 48 and the second securing latch 44. The first pivot pins 60 pass through corresponding bores formed in the rocker assemblies 48 and the connector links 50, while the second pivot pins 62 pass through corresponding bores formed in the second securing latch 44 and the connector links 50.

In the exemplary embodiment, the actuator 46 is a hydraulic piston and cylinder device having a piston 52 and a cylinder 54. The piston 52 is pivotally connected to the first securing latch 42 for moving the first latch 42 between latched and unlatched positions. The cylinder 54 is pivotally connected to the rocker assemblies 48 for moving them between first and second positions. The movement of the rocker assemblies 48 translates the reciprocating linear motion of the actuator 46 into rotational movement of the connector links 50. This rotational movement of the connector links 50 moves the second securing latch 44 between latched and unlatched positions. It will be appreciated that the actuator 46 can be any type of actuator, such as a motor-driven screw jack.

With reference to FIGS. 3 and 4, the over-center locking system 40 will now be described in more detail. In the exemplary embodiment, the locking system 40 is attached to the frame 12 of the quick coupler 10 at three locations. First, pivot pin 68 passes through corresponding bores formed in the first securing latch 42 and the plates 14 for pivotally connecting the first securing latch 42 to the front portion 20 of the frame 12. Second, rocker pins 70 pass through corresponding bores formed in each rocker assembly 48 and each plate 14 for pivotally connecting the rocker assemblies 48 to the frame 12. Third, pivot pin 72 passes through corresponding bores formed in the second securing latch 44 and the plates 14 for pivotally connecting the second securing latch 44 to the rear portion 22 of frame 12.

The frame 12 includes several features for supporting, and facilitating operation of, the over-center locking system 40. For example, the frame 12 can include a cross-brace 76 that is located proximate to the rear portion 22 of the frame 12 and projects or extends from one side plate 14 to the other for, among other things, interconnecting and supporting the plates 14. The frame 12 also includes a projection or finger 78 extending from the upper plate 16 and a boss 80 located on the cross plate 15.

For supporting the operation of the locking system 40, the cross-brace 76 includes stops 84, 86. It will be appreciated that stops 84, 86 can be provided by a boss or projection, separate and distinct from the cross-brace 76. As shown in FIG. 4, stop 86 provides a contact surface for a corresponding surface 90 of the rocker assemblies 48 when the rocker assemblies 48 are in the first position and the locking system 40 is latched. Similarly, as shown in FIG. 3, stop 84 provides a contact surface for a corresponding surface 88 of the rocker assemblies 48 when the rocker assemblies 48 are in the second position and the locking system 40 is unlatched.

Additionally, a jaw 82 is formed in the cross-brace 76. The jaw 82 is shaped to correspond to the shape of the recesses 32 of the plates 14. Accordingly, the jaw 82 receives pin 5' of the implement 2 for supporting a portion of the load associated with pin 5'.

A finger 78 and a boss 80 are disposed proximate to the front portion 20 of the frame 12 and participate in the operation of the system 40 to unlatch and latch the securing latches 42, 44. For example, to unlatch the securing latches 42, 44, the piston 52 retracts into the cylinder 54, moving the securing latch 42 into contact with the finger 78. Continued retraction of the piston 52 pushes the latch 42 against the finger 78 and pulls the cylinder 54 forward, toward the first latch 42. This causes the rocker assemblies 48 to pivot about pin 70 and the connector links 50 to move, thereby moving the second latch 44 upward, away from the recess 32. Similarly, to latch the securing latches 42, 44, the piston 52 extends, thereby moving the first latch 42 into contact with the boss 80 or the pin 5. After such contact, the extension of the piston 52 continues and this movement pushes the first latch 42 against boss 80 or the pin 5 and pushes the cylinder 54 away from the first latch 42. The moving cylinder 54 causes the rocker assemblies 48 to pivot about pin 70 and the connector links 50 to move, thereby moving the second securing latch 44 downward, toward the recess 32.

Operation of the over-center feature of the connecting system 40, which prevents the system 40 from unlatching should the actuator 46 fail, will now be described. This discussion references centerline 100, which, as shown in FIGS. 3 and 4, extends between the second pivot pin 62 and the rocker pivot pin 70.

When moving from the latched position to the unlatched position, the over-center system 40 rotates the second securing latch 44 counterclockwise, toward the pin 5' (or empty recess 32) before rotating it clockwise, away from the pin 5'. This is because, when the retracting actuator 46 rotates the rocker assembly 48 in the clockwise direction while the first pin 60 is below the centerline 100, the connector link 50 pushes the second securing latch 44 such that it rotates in the counterclockwise direction, which is downward, toward the pin 5'. Continued rotation of the rocker assembly 48 moves the first pin 60 above the centerline 100, which causes the connector link 50 to pull the second securing latch 44 such that it rotates in the clockwise direction, which is upward and away from the 5'.

Likewise, when the over-center system 40 moves from the unlatched to the latched position, the second securing latch 44 rotates in a counterclockwise direction, toward the pin 5' and then, in a final motion, rotates in a clockwise direction, away from the pin 5'. This is because, as the extending actuator 46 rotates the rocker assembly 48 in the counterclockwise direction while the first pin 60 is above the centerline 100, the connector link 50 pushes the second securing latch 44 such that it rotates in the counterclockwise direction. When the first pin 60 crosses below the centerline 100, the connector link 50 pulls the second securing latch 44 such that it rotates in a clockwise direction, away from the pin 5', thereby creating a gap between the pin 5' and the latch 44. This clockwise rotation continues until the rocker assembly 48 contacts the cross-brace 76.

When the system 40 is in the latched position, the second securing latch 44 will not rotate in the clockwise direction until the first pin 60 is above the centerline 100. Accordingly, should an opening force 102 act on the second securing latch 44 when the system 40 is latched, i.e., when the first pin 60 is below the centerline 100, the latch 44 will not open, even if the actuator 46 is not working properly. Instead, the opening force 102 secures the latch 44 in the latched position. More specifically, the opening force 102 creates a moment 104 in the clockwise direction about pin 72, a biasing force 106 that acts on the connector link 50, and a moment 108 in the counterclockwise direction about rocker pin 70. Because the first pivot pin 60 is located between the centerline 100 and the cross-brace 76, the biasing force 106 and the moment 108 combine to create reaction forces 110, 112 that secure the rocker assembly 48 against the cross-brace 76. Accordingly, any force, e.g., opening force 102, that pin 5' may apply on the second latch 44 will secure the rocker assembly 48 against the cross-brace 76, thereby locking the second securing latch 44 in the latched position.

It should be appreciated that wear from repeated use or warping from heavy loading may alter the coupler 10 in a manner that prevents the rocker assembly 48 from properly seating against the cross-brace or projection 76. In this event, the second securing latch 44 and the rocker assembly 48 have corresponding surfaces 116, 118 for securing the system 40 in the latched position. For example, when the system 40 is in the latched position, as shown in FIG. 4, the opening force 102 acting on the securing latch 44 creates moment 104 acting in clockwise direction about pin 72, which may push surfaces 116, 118 into abutting contact, thereby creating reaction forces 120, 122 for securing the second securing latch 44 in the latched position. It should also be appreciated that surfaces 116, 118 are in abutting contact when the system 40 is in the latched position, even when the rocker assembly 48 is properly seated against the cross-brace 76. This provides additional support for keeping the second securing latch 44 in the latch position should the actuator 46 fail.

INDUSTRIAL APPLICABILITY

The industrial applicability of the quick coupler 10 described herein will be readily appreciated from the foregoing discussion. The present disclosure is applicable to machines, such as excavators, that are used for multiple functions. For example, a single excavator may be used for excavating dirt, rock and other material, and during the excavation operations different implements may be required, such as a different size of bucket, an impact breaker or a grapple. The quick coupler 10 can be used to quickly change from one implement to another with ease, thus reducing the time the machine is unavailable for its intended purpose.

In operation, the quick coupler 10 is first attached to the arm 4 of a machine, such as an excavator. To achieve this attachment, pins 6, 6' are inserted through pin openings formed in the end of the arm 4 and the link 8. Pins 6, 6' are concurrently inserted through pin openings 28 formed in plates 14 of the quick coupler 10. To lock the pins 6, 6' within the pin openings 28, locking pins (not shown) are inserted through the securing slots 31 of the collars 29 and through slots (not shown) formed in the pins 6, 6'. Thus, the quick coupler 10 is securely attached to the end of the arm 4.

To attach an implement 2 to the quick coupler 10, the arm is maneuvered to position the quick coupler 10 above the implement 2. The quick coupler 10 is oriented so that recesses 32 and the jaw 82 are directed downward toward the implement 2. The quick coupler 10 is lowered onto the implement 2 so that the pin 5' of the implement 2 is seated within the recesses 32 and the jaw 82 of the quick coupler 10. The power link 8 of the arm 4 is next activated to pivot the quick coupler 10 about the pin 5' such that notch 30 is moved toward the other pin 5 of the implement 2. The other pin 5 is then seated within the notch 30.

To secure the pins 5, 5' within the notches 30, the recesses 32, and the jaw 82, the actuator 46 is activated to extend its piston 52, causing the rocker assemblies 48 to rotate downward, toward surface 86 of cross-brace 76. The moving rocker assemblies 48 translate the reciprocating linear motion of the actuator 46 into rotational movement of the connector links 50, and the rotational movement of the connector links 50 moves the second securing latch 44 downward and forward toward the recesses 32 and the jaw 82 until the connector links 50 move beyond the center line 100, surfaces 90 of the rocker assemblies 48 contact surface 86 of the cross-brace 76, and the pin 5' is secured in recesses 32 and the jaw 82.

The extending piston 52 also causes the first securing latch 42 to pivot downward and forward toward the notches 30 until securing the pin 5 in the notches 30. If the quick coupler 10 is not pivoted sufficiently about the pin 5' and the other pin 5 fails to properly seat in the notches 30, then the first securing latch 42 will move beyond the notches 30 until its surface 98 contacts the boss 80. Accordingly, when the first securing latch 42 fails to make contact with the pin 5, it will instead contact boss 80. Once the first securing latch 42 contacts either the pin 5 or the boss 80, the extending piston 52 either causes the cylinder 54 to move toward the rear portion 22 of the frame 12 for latching the system 40 or, if the system 40 is already latched, the extending piston 52 locks the system 40 in the latched position. Once the system 40 is latched, the implement 2 is securely connected to the quick coupler 10 and the arm 4 of the excavator.

To detach the implement 2 from the quick coupler 10, the actuator 46 is activated to retract its piston 52. Such retraction moves the first securing latch 42 upward and away from the notch 30 until surface 96 of the first latch 42 contacts the finger 78. Once surface 96 contacts the finger 78, the retracting piston 52 moves the cylinder 54, including the rocker assemblies 48 connected thereto, upward and away from contact surface 86 of the cross-brace 76. The upward moving rocker assemblies 48 move the links 50 out of the over-center position, which causes the second securing latch 44 to move upward and away from the recesses 32 and the jaw 82.

Once the securing latches 42, 44 are sufficiently withdrawn from notches 30, recesses 32, and the jaw 82, then the link 8 of the aim 4 is activated to pivot the quick coupler 10 about the pin 5' such that the notch 30 is moved away from the pin 5. Next, the arm 4 is activated to lift the quick coupler 10 away from the implement 2.

The presently disclosed quick coupler 10 employing the over-center latching system 40 eliminates the need for including a compression spring about the piston 52 that acts as a safety back-up for securing latches 42, 44 in the latched position should the actuator 46 fail. Further, the present device eliminates the need to manually install locking pins through aligned openings in the frame to prevent the latches 42, 44 from unlatching.

It will be appreciated that the foregoing description provides examples of the disclosed system and technique. However, it is contemplated that other implementations of the disclosure may differ in detail from the foregoing examples. All references to the invention or examples thereof are intended to reference the particular example being discussed at that point and are not intended to imply any limitation as to the scope of the invention more generally. All language of distinction and disparagement with respect to certain features is intended to indicate a lack of preference for those features, but not to exclude such from the scope of the invention entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

We claim:

1. A quick coupler assembly for connecting an implement having a pin to an arm of a machine, the quick coupler assembly including a frame that has a recess configured to receive the pin of the implement, the quick coupler comprising:

a securing latch pivotally connected to the frame and movable between latched and unlatched positions for removably latching the pin in the recess;

a rocker assembly pivotally connected to the frame by a rocker pivot pin; and a connector link pivotally connected to the securing latch by a first pivot point and pivotally connected to the rocker assembly by a second pivot point, wherein the securing latch, the rocker assembly, and the connector link are movable to a position where the rocker assembly contacts the securing latch for securing the securing latch in the latched position, and wherein, in the latched position, the second pivot point is located below a centerline defined by a plane extending between the first pivot pin and the rocker pivot pin.

2. A locking system for use in a quick coupler assembly for connecting an implement having a pin to an arm of a machine, the quick coupler assembly including a frame that has a recess configured to receive the pin of the implement, the locking system comprising:

a securing latch movable between latched and unlatched positions for removably latching the pin in the recess;

a rocker assembly;

a connector link pivotally interconnecting the rocker assembly and the securing latch; and a stop, the connector link configured to transform an opening force acting on the securing latch into a biasing force for biasing the rocker assembly against the stop.

3. The locking system of claim 2, further comprising:

a securing latch pivot pin for pivotally connecting the securing latch to the frame.

4. The locking system of claim 3, wherein the opening force acting on the securing latch creates a moment about the securing latch pivot pin, the moment creates the biasing force in the connector link, the biasing force biases the rocker assembly against the stop and prevents the opening force from moving the securing latch from the latched position to the unlatched position.

5. A method of connecting a quick coupler assembly to an implement having first and second pins, the quick coupler assembly having a frame with front and rear portions and first and second recesses, the first recess located proximate to the front portion and the second recess located proximate to the rear portion thereof, the first recess configured to receive the first pin of the implement and the second recess configured to receive the second pin of the implement, the method comprising:

actuating a hydraulic or electric actuator;

moving, in response to the actuation of the actuator, a first securing latch located proximate to the front portion of the frame and movable between latched and unlatched positions for removably latching the first pin in the first recess until the first securing latch reaches its latched position; and moving, in response to the actuation of the actuator, a second securing latch located proximate to the rear portion of the frame and movable between latched and unlatched positions for removably latching the second pin in the second recess, the second securing latch moving in a first direction in response to the actuation of the actuator, and then as the actuator continues to actuate and in response thereto moving the second securing latch briefly in a second direction opposite the first direction until the second securing latch reaches its latched position.

6. A method of connecting a quick coupler assembly to an implement according to claim 5, wherein the actuation of the actuator moving a first securing latch further comprises applying a force from the actuator to the first securing latch via a pivot pin, the first securing latch being pivotally connected to the actuator via the pivot pin.

7. A method of connecting a quick coupler assembly to an implement according to claim 5, wherein moving the second securing latch briefly in a second direction opposite the first direction until the second securing latch reaches its latched position further comprises contacting a stop surface with the second securing latch when the second securing latch reaches its latched position.

8. A method of connection a quick coupler assembly to an implement according to claim 5 wherein the actuation of the actuator moving a second securing latch further comprises rotating a rocker assembly in response to the actuation of the actuator, and contacting a stop surface with the rocker assembly when the second securing latch reaches its latched position.

9. A quick coupler assembly for connecting an implement having first and second pins to an arm of a machine, the quick coupler assembly comprising:

a frame having front and rear portions and first and second recesses, the first recess located proximate to the front portion and the second recess located proximate to the rear portion thereof, the first recess configured to receive the first pin of the implement and the second recess configured to receive the second pin of the implement;

a first securing latch located proximate to the front portion of the frame and movable between latched and unlatched positions for removably latching the first pin in the first recess;

a second securing latch located proximate to the rear portion of the frame and movable between latched and unlatched positions for removably latching the second pin in the second recess;

a rocker assembly pivotally connected to the frame;

a hydraulic or electric actuator pivotally connected to the first securing latch, the actuator also pivotally connected to the rocker assembly; and a connector link pivotally connected to the rocker assembly, the connector link also pivotally connected to the second securing latch.

10. The quick coupler assembly of claim 9 wherein when the actuator extends it applies a force to both the first securing latch to move the first securing latch to its latched position and to the second securing latch to move the second securing latch to its latched position.

11. The quick coupler assembly of claim 10 wherein the actuator is a hydraulic actuator including a piston and a cylinder, the piston being pivotally connected to the first securing latch, and the cylinder being pivotally connected to the rocker assembly.

12. The quick coupler assembly of claim 9 the first securing latch is pivotally connected to the frame and the second securing latch is pivotally connected to the frame.

13. The quick coupler assembly of claim 9 wherein when the second securing latch is in its latched position the rocker assembly makes contact with second securing latch.

14. The quick coupler assembly of claim 9 wherein when the second securing latch is in its latched position the rocker assembly makes contact with a stop formed on the frame.

15. The quick coupler of claim 9 wherein:

the rocker assembly is pivotally connected to the frame via a rocker pin;

the connector link is pivotally connected to the rocker assembly via a first pivot pin, the connector link is also pivotally connected to the second securing latch via a second pivot pin; and when the second securing latch is in its unlatched position the first pivot pin is on one side of a line connecting the second pivot pin and the rocker pin, and when the second securing latch is in its latched position the first pivot pin is on the opposite side of the line.

16. A quick coupler assembly for connecting an implement having first and second pins to an arm of a machine, the quick coupler assembly comprising:

a frame having front and rear portions and first and second recesses, the first recess located proximate to the front portion and the second recess located proximate to the rear portion thereof, the first recess configured to receive the first pin of the implement and the second recess configured to receive the second pin of the implement;

a first securing latch pivotally connected by a first latch pivot pin located proximate to the front portion of the frame and movable between latched and unlatched positions for removably latching the first pin in the first recess;

a second securing latch pivotally connected by a second latch pivot pin located proximate to the rear portion of the frame and movable between latched and unlatched positions for removably latching the second pin in the second recess;

a rocker assembly pivotally connected to the frame by a rocker pivot pin; and a hydraulic or electric actuator which extends and contracts, the actuator pivotally connected to the first securing latch, and the actuator also pivotally connected to the rocker assembly.

17. A quick coupler assembly according to claim 16 wherein the actuator is not itself directly connected to the frame.

18. A quick coupler assembly according to claim 17 wherein:

the actuator is a hydraulic actuator comprising a piston and a cylinder, the cylinder includes pivots which extend away from the cylinders on opposite sides thereof; and the actuator is pivotally connected to the rocker assembly via the pivots extending into bores formed on the rocker assembly.

19. A quick coupler assembly for connecting an implement having first and second pins to an arm of a machine, the quick coupler assembly comprising:

a frame having front and rear portions and first and second recesses, the first recess located proximate to the front portion and the second recess located proximate to the rear portion thereof, the first recess configured to receive the first pin of the implement and the second recess configured to receive the second pin of the implement;

a first securing latch located proximate to the front portion of the frame and movable between latched and unlatched positions for removably latching the first pin in the first recess;

a second securing latch located proximate to the rear portion of the frame and movable between latched and unlatched positions for removably latching the second pin in the second recess;

a hydraulic or electric actuator which extends and contracts and is connected to the first securing latch to move the first securing latch between its latched and unlatched positions; and an over-center mechanism connecting the actuator to the second securing latch to move the second securing latch between its latched and unlatched positions;

wherein when the second securing latch is in its latched position, an opening force from the second pin acting on the second securing latch to urge it to its unlatched position is counteracted by a resultant force created in the over-center mechanism to urge the second securing latch to its latched position.

20. A quick coupler assembly according to claim 19 wherein the over-center mechanism includes a rocker assembly and when the second securing latch is moving from its unlatched position to its latched position the rocker assembly pivots in a first direction and continues pivoting in its first direction until the rocker assembly contacts a stop to prevent further pivoting of the rocker assembly and define the latched position of the second securing latch.

21. A quick coupler assembly for connecting an implement having first and second pins to an arm of a machine, the quick coupler assembly comprising:

a frame having front and rear portions and first and second recesses, the first recess located proximate to the front portion and the second recess located proximate to the rear portion thereof, the first recess configured to receive the first pin of the implement and the second recess configured to receive the second pin of the implement;

a first securing latch located proximate to the rear portion of the frame and movable between latched and unlatched positions for removably latching the second pin in the second recess;

a hydraulic or electric actuator which extends and contracts; and an over-center mechanism connecting the actuator to the first securing latch to move the first securing latch between its latched and unlatched positions, the over-center mechanism comprising a rocker assembly and a connecting link, the rocker assembly is pivotally connected to the actuator, the rocker assembly is pivotally connected to the frame via a rocker pin, the connector link is pivotally connected to the rocker assembly via a first pivot pin, the connector link is also pivotally connected to the first securing latch via a second pivot pin; and when the first securing latch is in its unlatched position the first pivot pin is on one side of a line connecting the second pivot pin and the rocker pin, and when the first securing latch is in its latched position the first pivot pin is on the opposite side of the line.

22. A quick coupler assembly according to claim 21 further comprising:

a second securing latch located proximate to the front portion of the frame and movable between latched and unlatched positions for removably latching the first pin in the first recess, the second securing latch being connected to the actuator to move the second securing latch between its latched and unlatched positions.

23. A quick coupler assembly according to claim 21 wherein when the first securing latch is in its latched position the rocker assembly makes contact with first securing latch.

24. The quick coupler assembly of claim 21 wherein when the first securing latch is in its latched position the rocker assembly makes contact with a stop formed on the frame.

* * * * *